US012611038B2

(12) United States Patent
Deng

(10) Patent No.: US 12,611,038 B2
(45) Date of Patent: Apr. 28, 2026

(54) COMFORTABLE CHAIR SUITABLE FOR MULTIPLE USAGE POSTURES

(71) Applicant: NEWTRAL FURNITURE TECHNOLOGY INC., Shenzhen (CN)

(72) Inventor: Jianbo Deng, Shenzhen (CN)

(73) Assignee: NEWTRAL FURNITURE TECHNOLOGY INC., Shenzhen (CN)

( * ) Notice: Subject to any disclaimer, the term of this patent is extended or adjusted under 35 U.S.C. 154(b) by 168 days.

(21) Appl. No.: 18/638,819

(22) Filed: Apr. 18, 2024

(65) Prior Publication Data

US 2025/0295239 A1 Sep. 25, 2025

Related U.S. Application Data

(63) Continuation of application No. PCT/CN2024/084023, filed on Mar. 27, 2024.

(30) Foreign Application Priority Data

Mar. 22, 2024 (CN) ..... 202420569297.2

(51) Int. Cl.
*A47C 7/70* (2006.01)
*A47C 1/03* (2006.01)
(Continued)

(52) U.S. Cl.
CPC ..... *A47C 7/70* (2013.01); *A47C 1/0305* (2018.08); *A47C 1/0308* (2018.08); *A47C 7/004* (2013.01);
(Continued)

(58) Field of Classification Search
CPC ..... A47C 7/70; A47C 1/0305; A47C 1/0308; A47C 7/004; A47C 7/402; A47C 7/541;
(Continued)

(56) References Cited

U.S. PATENT DOCUMENTS 137,062 A * 3/1873 Croghan ..... A47C 17/12 297/119
156,177 A * 10/1874 Schabel et al. ..... A47C 17/12 297/116
(Continued)

FOREIGN PATENT DOCUMENTS

CN 201520175868 * 7/2015 ..... A47B 39/00

*Primary Examiner* — Medhat Badawi
(74) *Attorney, Agent, or Firm* — HOWARD M COHN and Associates, LLC

(57) ABSTRACT

The utility model discloses a comfortable chair suitable for multiple usage postures. An overturnable desk board is arranged on a chair backrest, and a desk board adjustment mechanism can fix the angle of the desk board and support the desk board. The chair is provided with overturnable chair armrests, and armrest angle adjustment mechanisms can adjust the angle of the armrests, so as to provide users with various usage postures, realizing high flexibility and practicality. Embedded armrests are also arranged on the chair armrests and can be equipped with matching small desk boards. With embedded armrest adjustment mechanisms, the embedded armrests can be adjusted in both height and forward/backward position, so as to cater to users of different body types and heights.

7 Claims, 8 Drawing Sheets

(51) Int. Cl.

| | |
|---|---|
| ***A47C 7/00*** | (2006.01) |
| ***A47C 7/40*** | (2006.01) |
| ***A47C 7/54*** | (2006.01) |
| *A47C 7/68* | (2006.01) |
| *A47C 13/00* | (2006.01) |

(52) U.S. Cl.
CPC ..... *A47C 7/402* (2013.01); *A47C 7/541* (2018.08); *A47C 1/0307* (2018.08); *A47C 7/705* (2018.08); *A47C 13/005* (2013.01)

(58) Field of Classification Search
CPC ..... A47C 1/0307; A47C 7/705; A47C 13/005; A47C 9/002
See application file for complete search history.

(56) References Cited

U.S. PATENT DOCUMENTS

| | | | | | |
|---|---|---|---|---|---|
| 352,723 | A * | 11/1886 | Weeden | B60N 2/3084 | 297/112 |
| 863,874 | A * | 8/1907 | Rajner | A47C 17/18 | 297/411.27 |
| 1,025,266 | A * | 5/1912 | Harman | A47C 17/12 | 297/116 |
| 2,790,485 | A * | 4/1957 | Franklin | A47C 17/12 | 297/116 |
| 5,630,649 | A * | 5/1997 | Heidmann | A47C 1/03274 | 297/344.19 |
| 7,093,904 | B1 * | 8/2006 | McMillen | A47C 7/543 | 297/411.32 |
| 9,693,634 | B2 * | 7/2017 | Smith | A47B 83/021 | |
| D882,978 | S * | 5/2020 | Fribush | D6/366 | |
| 10,912,423 | B2 * | 2/2021 | Williams | A47K 3/282 | |
| D943,298 | S * | 2/2022 | Abadie | D6/716.4 | |
| 11,241,978 | B2 * | 2/2022 | Da Silva | B60N 2/02 | |
| D977,854 | S * | 2/2023 | Abadie | D6/360 | |
| 11,717,089 | B2 * | 8/2023 | Lazar | A47C 7/024 | 297/29 |
| D1,064,625 | S * | 3/2025 | Deng | D6/367 | |
| 2019/0223603 | A1 * | 7/2019 | France | A47C 7/006 | |
| 2025/0248525 | A1 * | 8/2025 | Deng | A47C 7/70 | |
| 2025/0295239 | A1 * | 9/2025 | Deng | A47C 7/70 | |

* cited by examiner

COMFORTABLE CHAIR SUITABLE FOR MULTIPLE USAGE POSTURES

BACKGROUND OF THE INVENTION

1. Technical Field

The utility model relates to the technical field of chairs, in particular to a comfortable chair suitable for multiple usage postures.

2. Description of Related Art

In everyday life, people have frequent interaction with various objects. Among them, chairs are items that people of all age groups need and use. People spend a considerable amount of time sitting in chairs for work or study. During these moments, people usually have demands for the comfort and practicality of chairs, especially for those who work from home or frequently use temporary offices, chairs become essential office aids.

In the prior art, most chairs only have the function of adjusting the seat height and are typically suitable for traditional sitting postures. These chairs lack versatility in terms of usage modes. For instance, the armrests of the chair could be designed to fold, allowing the armrests to be folded to a horizontal state to form a reclining chair together with the seat; alternatively, the armrest on one side could be folded independently, providing a sideways sitting posture; and another option is to incorporate a folding desk board on the backrest of the chair, enabling users to sit in a reverse position and use the folding desk board for office work. Therefore, there is a pressing need for a chair that can offer multiple usage postures, addressing the limitations of the prior art.

BRIEF SUMMARY OF THE INVENTION

In response to the shortcomings of the prior art where chairs lack versatility in terms of usage postures, the utility model provides a comfortable chair suitable for multiple usage postures.

To achieve the above purpose, the utility model provides a comfortable chair suitable for multiple usage postures, comprising:

a chair seat and chair legs, a pneumatic rod being arranged between the chair seat and the chair legs, and the chair seat and the chair legs being connected through the pneumatic rod;

two chair armrests symmetrically arranged on two sides of the chair seat;

a chair backrest, a backrest frame and a backrest support being arranged on a side, away from the chair seat, of the chair backrest, a desk board being arranged in the backrest frame, the chair backrest being connected with the chair seat through the backrest support, and the desk board being connected with the backrest frame in an overturnable manner; and at least one desk board adjustment mechanism arranged on a surface of the backrest frame, the desk board adjustment mechanism comprising a strip-shaped chute, a sliding stop block and an overturning shaft, the sliding stop block being in sliding fit with the strip-shaped chute, a wall of the strip-shaped chute being provided with at least one first limiting slot, one side of the sliding stop block being provided with a limiting protrusion which is able to be embedded into the first limiting slot, and two ends of the overturning shaft being respectively connected with the sliding stop block and the desk board in an overturnable manner; wherein the overturning of the desk board drives the overturning shaft, so that the sliding stop block slides in the strip-shaped chute, and when the limiting protrusion is snapped into the limiting slot, the angle of the desk board is fixed.

As an improvement scheme of the utility model, two ends of a bottom of the chair backrest are recessed towards a center of the chair backrest to form concave parts, and an edge of the backrest frame is provided with a mounting slot for mounting fabric.

As an improvement scheme of the utility model, an end, away from the chair seat, of the chair armrest is provided with the embedded armrest, an embedded armrest adjustment mechanism and a housing, the embedded armrest adjustment mechanism is arranged in the housing, the housing is arranged in the chair armrest, and the embedded armrest is able to move relative to the chair armrest through the embedded armrest adjustment mechanism.

As an improvement scheme of the utility model, the embedded armrest adjustment mechanism comprises sliding blocks, a height adjustment handle, a lifting rod and a lifting cylinder, a side, close to the chair armrest, of the embedded armrest is provided with a strip-shaped slot hole, one end of at least one sliding block is arranged in the strip-shaped slot hole, and the other end is fixedly connected with the housing; and the height adjustment handle is arranged on a side, away from the chair seat, of the housing, and is integrated with the lifting rod, the lifting rod is arranged in a chamber of the lifting cylinder, and is provided with stop blocks, at least one height fixing hole is arranged on a chamber surface, close to the stop blocks, of the lifting cylinder, and the stop blocks are able to be snapped into the height fixing holes.

As an improvement scheme of the utility model, an armrest angle adjustment mechanism is provided, the chair armrest is movably connected with the chair seat through the armrest angle adjustment mechanism, and the armrest angle adjustment mechanism comprises a rotating rod, a fixed rod and a rotating wheel; one end of the rotating rod is fixedly connected with the chair armrest, and the other end is rotatably connected with the rotating wheel; and two ends of the fixed rod are respectively fixedly connected with the rotating wheel and the chair seat, and the adjustment range of an included angle between the chair armrest and the chair seat is from acute to reflex angles.

As an improvement scheme of the utility model, a surface of one end, close to the chair backrest, of the backrest support is provided with a limiting through hole, and the backrest support is sleeved with a fixing block which is fixed on the chair backrest; the fixing block is sleeved outside the backrest support, at least one second limiting slot is arranged in the limiting through hole, and the fixing block is able to be snapped into the second limiting slot; and the chair backrest slides on the backrest support through the fixing block to adjust the longitudinal height.

The utility model has the beneficial effects that compared with the prior art, the comfortable chair suitable for multiple usage postures provided by the utility model comprises a chair seat, chair legs, two chair armrests, desk board adjustment mechanisms and a chair backrest; a pneumatic rod is arranged between the chair seat and the chair legs, and the chair seat and the chair legs are connected through the pneumatic rod; the chair armrests are symmetrically arranged on two sides of the chair seat; a backrest frame is arranged on a side, away from the chair seat, of the chair backrest, a desk board is arranged in the backrest frame, the chair backrest is connected with the chair seat through the backrest support, and the desk board is connected with the backrest frame in an overturnable manner; and the at least one desk board adjustment mechanism is fixedly arranged on a surface of the backrest frame, the desk board adjustment mechanism comprises a strip-shaped chute, a sliding stop block and an overturning shaft, the sliding stop block is in sliding fit with the strip-shaped chute, a wall of the strip-shaped chute is provided with at least one limiting slot, one side of the sliding stop block is provided with a limiting protrusion which is able to be embedded into the limiting slot, and two ends of the overturning shaft are respectively connected with the sliding stop block and the desk board in an overturnable manner. The utility model features a chair with multiple usable postures. The chair backrest is provided with an overturnable desk board, and the overturning angle of the desk board can be fixed through the desk board adjustment mechanism, allowing users to work, study or watch movies on the desk board. The chair armrest can be overturned through the armrest angle adjustment mechanism, with the angle between the chair armrest and the chair seat ranging from acute to reflex angles. When users want to lie down for resting, both armrests can be adjusted to a horizontal position, creating a bed together with the chair seat. The chair armrests can also be completely adjusted to a vertical downward state, making it more convenient for users to use the desk board and avoiding obstacles when using the desk board in a reverse seating position. Users can also adjust the angle of the chair armrest on one side only for sideways sitting. The overturnable desk board design allows users to change their sitting or lying posture without retracting it, adding convenience to the user experience. The embedded armrests that can be inserted into the desk board are further arranged on the chair armrests. The embedded armrest adjustment mechanism can make the embedded armrest slide in the forward-backward direction and adjust its height position, ensuring the comfort of users with different body types and heights.

Figure 1:
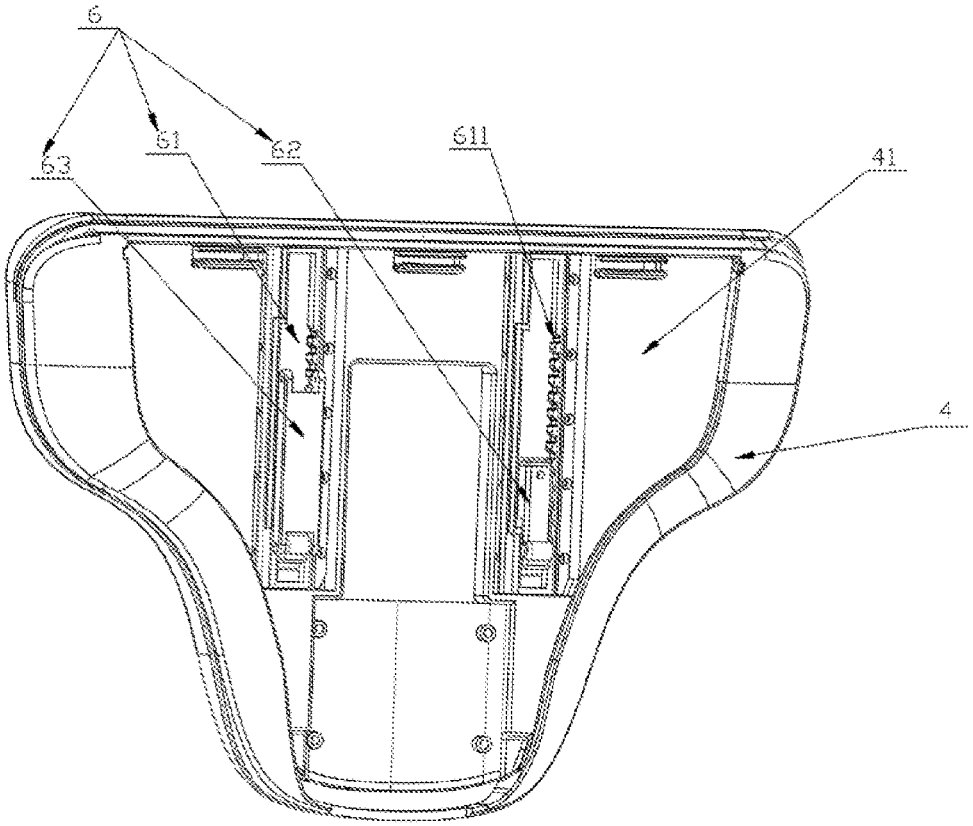
FIG. 1 is a diagram of a desk board adjustment mechanism of the utility model.
Figure 2:
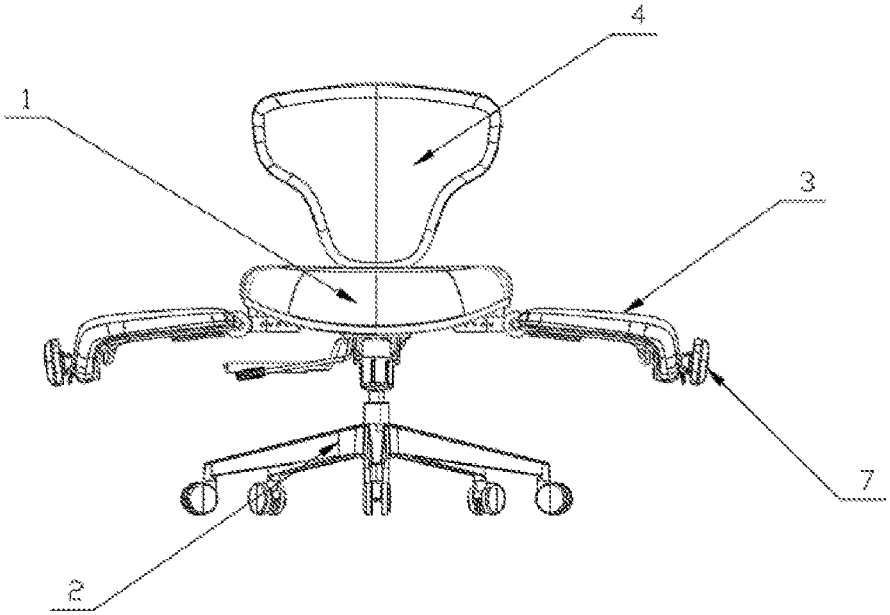
FIG. 2 is a front view of a working state of the utility model.

Main elements and corresponding symbols: 1. chair seat; 2. chair leg; 3. chair armrest; 31. armrest angle adjustment mechanism; 311. rotating rod; 312. fixed rod; 313. rotating wheel; 4. chair backrest; 41. backrest frame; 42. desk board; 411. mounting slot; 5. housing; 6. desk board adjustment mechanism; 61. strip-shaped chute; 611. first limiting slot; 62. sliding stop block; 621. limiting protrusion; 63. overturning shaft; 7. embedded armrest; 71. strip-shaped slot hole; 8. embedded armrest adjustment mechanism; 81. sliding block; 82. height adjustment handle; 83. lifting rod; 831. stop block; 84. lifting cylinder; 841. height fixing hole; 9. concave part; 10. backrest support; 100. limiting through hole; 101. second limiting slot; 11. fixing block; 12. pneumatic rod; 13. small desk board; 131. first mounting cylinder; 132. second mounting cylinder.

DETAILED DESCRIPTION OF THE INVENTION

In order to express the utility model more clearly, the utility model will be further described below in conjunction with attached drawings.

Please refer to FIGS. 1-10. A comfortable chair suitable for multiple usage postures provided by the utility model comprises a chair seat 1, chair legs 2, two chair armrests 3, a chair backrest 4 and a desk board adjustment mechanism 6; a pneumatic rod is arranged between the chair seat 1 and the chair legs 2, and the chair seat 1 and the chair legs 2 are connected through the pneumatic rod; the chair armrests 3 are symmetrically arranged on two sides of the chair seat 1; a backrest frame 41 is arranged on a side, away from the chair seat 1, of the chair backrest 4, a desk board 42 and a backrest support 10 are arranged in the backrest frame 41, the chair backrest 4 is connected with the chair seat 1 through the backrest support 10, and the desk board 42 is connected with the backrest frame 41 in an overturnable manner; at least one desk board adjustment mechanism 6 is arranged on a surface of the backrest frame 41; the desk board adjustment mechanism 6 comprises a strip-shaped chute 61, a sliding stop block 62 and an overturning shaft 63, the sliding stop block 62 is in sliding fit with the strip-shaped chute 61, a wall of the strip-shaped chute 61 is provided with at least one first limiting slot 611, and one side of the sliding stop block 62 is provided with a limiting protrusion 621 which can be embedded into the first limiting slot 611; two ends of the overturning shaft 63 are respectively connected with the sliding stop block 62 and the desk board 42 in an overturnable manner; the desk board 42 can be overturned to a horizontal state by the desk board adjustment mechanism 6, and supported by the overturning shaft 63, the strip-shaped chute 61 arranged in the backrest frame 41 is in sliding fit with the sliding stop block 62, and the limiting protrusion 621 arranged on a side of the sliding stop block 62 can be snapped into the first limiting slot 611, thus completing the angle fixation of the desk board 42; and by sliding the sliding stop block 62 to an extreme position, the limiting protrusion 621 disengages from the first limiting slot 611, thus allowing the desk board 42 to fold back to its original position.

The working principle of the utility model is as follows.

A user can sit in a reverse position on the chair seat 1 to work by overturning the desk board 42, and two sides of a bottom end of the chair backrest 4 are recessed inward to form concave parts 9, which allow the user to have ample leg space. The overturning shaft 63 of the desk board adjustment mechanism 6 is driven by the overturning of the desk board 42, so that the sliding stop block 62 slides in the strip-shaped chute 61. A side wall of the strip-shaped chute 61 is provided with the limiting slot 611, and the limiting protrusion 621 on a side of the sliding stop block 62 can be snapped into the limiting slot 611 to lock the overturning angle of the desk board 42. In order to make the user sit in a reverse position on the chair seat 1 to work comfortably and conveniently, an angle of the chair armrest 3 can be adjusted by an armrest angle adjustment mechanism 31, and the angle adjustment range is from acute to reflex angles between the chair armrest 3 and the chair seat 1. The chair armrests 3 can be adjusted to a horizontal state, allowing the user to lie flat on the seat for resting. The chair armrests can also be adjusted to a vertically downward state to avoid interference to the user, enabling the user to work in a comfortable posture while sitting in a reverse position on the chair seat 1. Alternatively, the angle of the armrest 3 on one side can be adjusted independently, allowing the user to sit sideways on the chair seat 1. To address the situation where the user does not want to sit in a reverse position on the chair seat 1 but wants to work using the desk board 42, an embedded armrest 7 is further arranged on the chair armrest 3, which is movably connected with the chair armrest 3 through an embedded armrest adjustment mechanism 71, and the embedded armrest adjustment mechanism 71 can make the embedded armrest 7 slide in the forward-backward direction and adjust its height position, so that the position of the desk board is suitable for users with different body types and heights.

In another embodiment, all the technical features of the above embodiment are included. In order to improve the user experience, referring to FIGS. 2-3 and 8-9, the armrest angle adjustment mechanisms 31 are provided. The armrest angle adjustment mechanism 31 comprises a rotating rod 311, a fixed rod 312 and a rotating wheel 313. One end of the rotating rod 311 is fixedly connected with the chair armrest 3, and the other end is rotatably connected with the rotating wheel 313. Two ends of the fixed rod 312 are respectively fixedly connected with the rotating wheel 313 and the chair seat 1. The rotating rod 311 is rotatably connected with the rotating wheel 313. When the user adjusts the angle of the chair armrest 3, the adjustment range of an included angle between the chair armrest 3 and the chair seat 1 is from acute to reflex angles. Multiple use angles can be realized based on the needs of users. The chair armrest 3 can be adjusted to a vertically downward state to work with the desk board 42, so as not to get in the way when the user sits in a reverse position or stands up from the reverse position. This allows the user to sit down directly from the side or sit down with legs open from the front. The chair armrests 3 can also be adjusted to a horizontal position to align with the chair seat 1. In this position, the user can lie flat on the seat for resting or meditate on the seat. The user can also adjust the chair armrest 3 on one side independently, either laying it flat or setting it in a vertical downward position. The adjustment of the chair armrests 3 enables the chair to have multiple usage postures, greatly improving the practicality of the utility model and enhancing the user experience.

In another embodiment, all the technical features of the above embodiment are included. In order to improve the user experience, referring to FIGS. 1-2 and 9, the two sides of the bottom of the chair backrest 4 are provided with the concave parts 9, which offer sufficient space, preventing discomfort caused by the obstruction of the chair backrest 4 to the legs. When users sit in a reverse position, they have ample space to place their legs, enabling them to work in a comfortable posture.

In another embodiment, all the technical features of the above embodiment are included. Referring to FIGS. 2-7 and 11, an end, away from the chair seat 1, of the chair armrest 3 is provided with the embedded armrest 7, the embedded armrest adjustment mechanism 8 and a housing 5, the embedded armrest adjustment mechanism 8 is arranged in the housing 5, and the embedded armrest 7 is movably connected with the chair armrest 3 through the embedded armrest adjustment mechanism 8. The embedded armrest adjustment mechanism 8 comprises sliding blocks 81, a height adjustment handle 82, a lifting rod 83 and a lifting cylinder 84. A side, close to the chair armrest 3, of the embedded armrest 7 is provided with a strip-shaped slot hole 71, one end of at least one sliding block 81 is arranged in the strip-shaped slot hole 71, and the other end is fixedly connected with the housing 5. The height adjustment handle 82 is arranged on a side, away from the chair seat 1, of the housing 5, and is integrated with the lifting rod 83. The lifting rod 83 is arranged in a chamber of the lifting cylinder 84, and is provided with stop blocks 831, and at least one height fixing hole 841 is arranged on a wall surface, close to the stop blocks 831, of the lifting cylinder 84. The embedded armrest 7 can be sleeved with a matching small desk board, allowing users to work when sitting in a forward-facing position. The embedded armrest adjustment mechanism 8 can make the embedded armrest 7 slide in the forward-backward direction and adjust its height position, and the sliding block 81 can slide in the strip-shaped slot hole 71 of the embedded armrest 7, so that the position in the forward-backward direction can be adjusted by sliding the embedded armrest 7. The lifting rod 83 is arranged in the lifting cylinder 84, the lifting rod 83 is provided with the stop blocks 831, and the stop blocks 831 are matched with the plurality of height fixing holes 841 formed in the chamber wall of the lifting cylinder 84. When the user lifts the height adjustment handle 82, the stop blocks 831 on the lifting rod 83 move out of the height fixing holes 841. In this case, the height of the embedded armrest 7 can be adjusted manually. When a desired height is reached, the height adjustment handle 82 is released, and the stop blocks 831 are snapped into the height fixing holes 841, thus completing the height adjustment of the embedded armrest 7. The embedded armrest adjustment mechanism 8 enables users of different heights and body types to find the most comfortable position, realizing flexible adjustments and enhancing the user experience.

Figure 11:
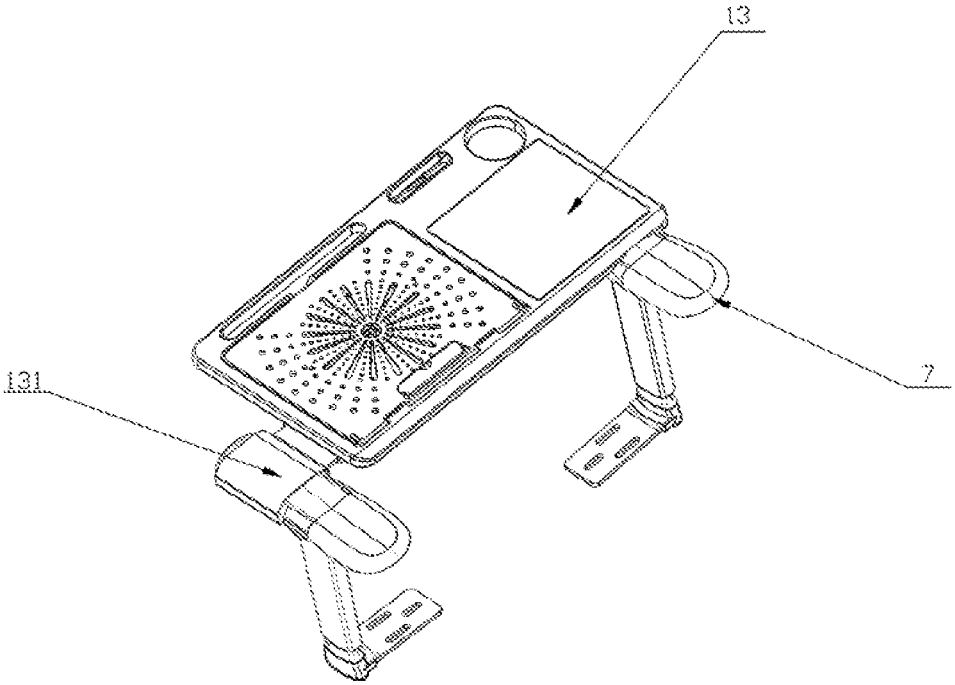
FIG. 11 is a diagram of the combination of an embedded armrest and a small desk board of the utility model.
Figure 12:
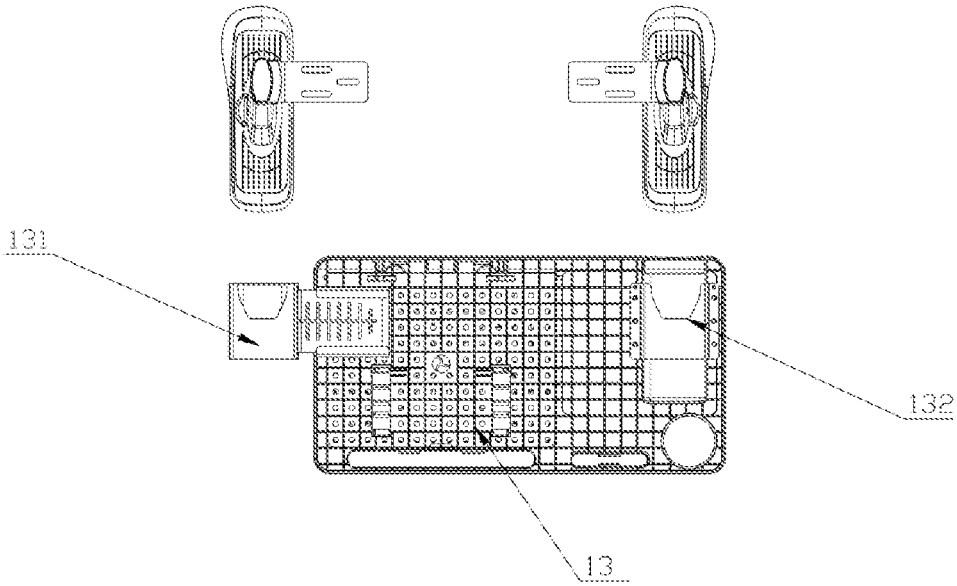
FIG. 12 is a bottom view of a small desk board and an embedded armrest of the utility model.

Further, referring to FIGS. 11-12, a bottom surface of the small desk board 13 is provided with a first mounting cylinder 131 and a second mounting cylinder 132 which can be sleeved outside the embedded armrest 7, and the small desk board is fixed on the embedded armrest 7 through the first mounting cylinder 131 and the second mounting cylinder 132, so that the user can use the small desk board 13 for work or study when sitting in a forward-facing position. The user can freely switch between forward-facing and reverse sitting positions. Moreover, with the assistance of the embedded armrest adjustment mechanism 8, the height and distance of the small desk board 13 can be adjusted within a certain range.

Figure 10:
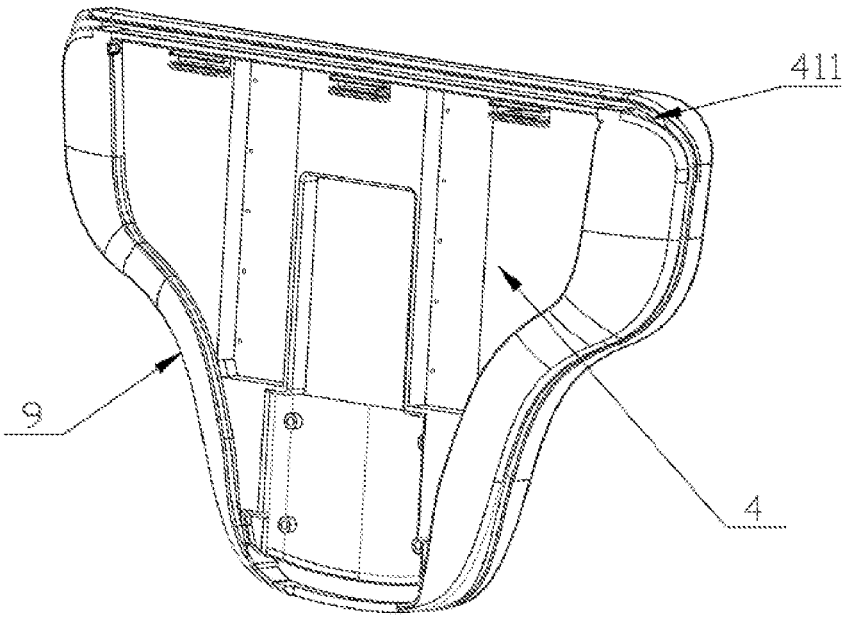
FIG. 10 is a diagram of a backrest frame of the utility model.

In another embodiment, all the technical features of the above embodiment are included. Referring to FIG. 10, an edge of the chair backrest 4 is provided with a mounting slot 411 for mounting fabric. By incorporating the mounting slot 411, it only requires placing fabric and filling sponge on a contact surface between the chair backrest 4 and the user. This not only ensures that the fabric stays securely in place within the mounting slot but also significantly reduces costs.

Figure 3:
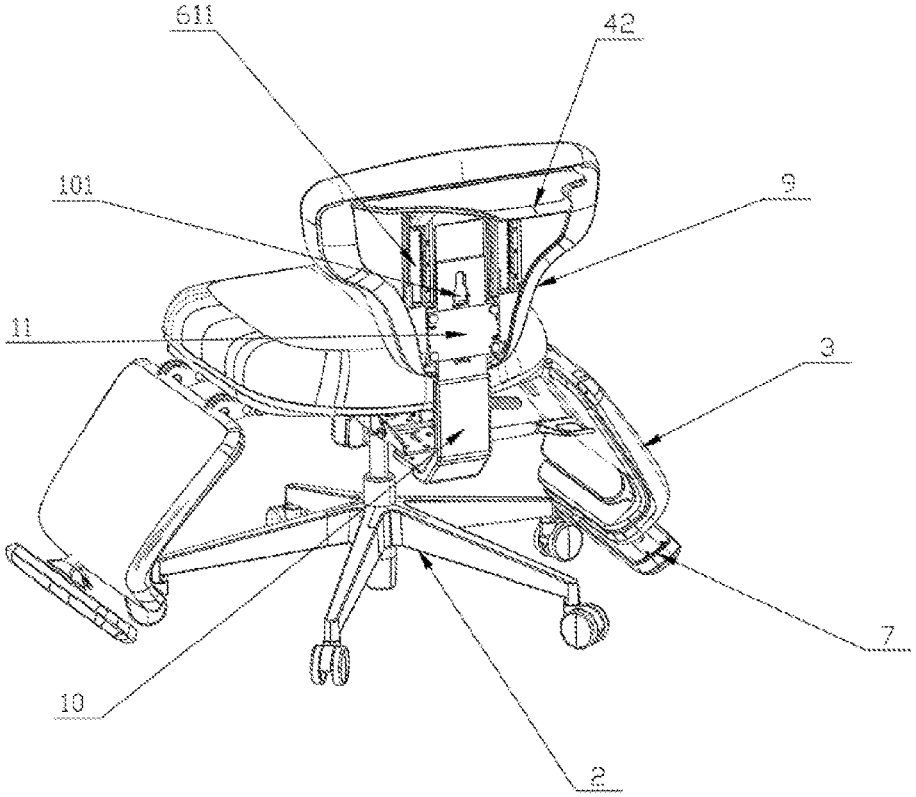
FIG. 3 is a perspective view of a working state of the utility model.
Figure 4:
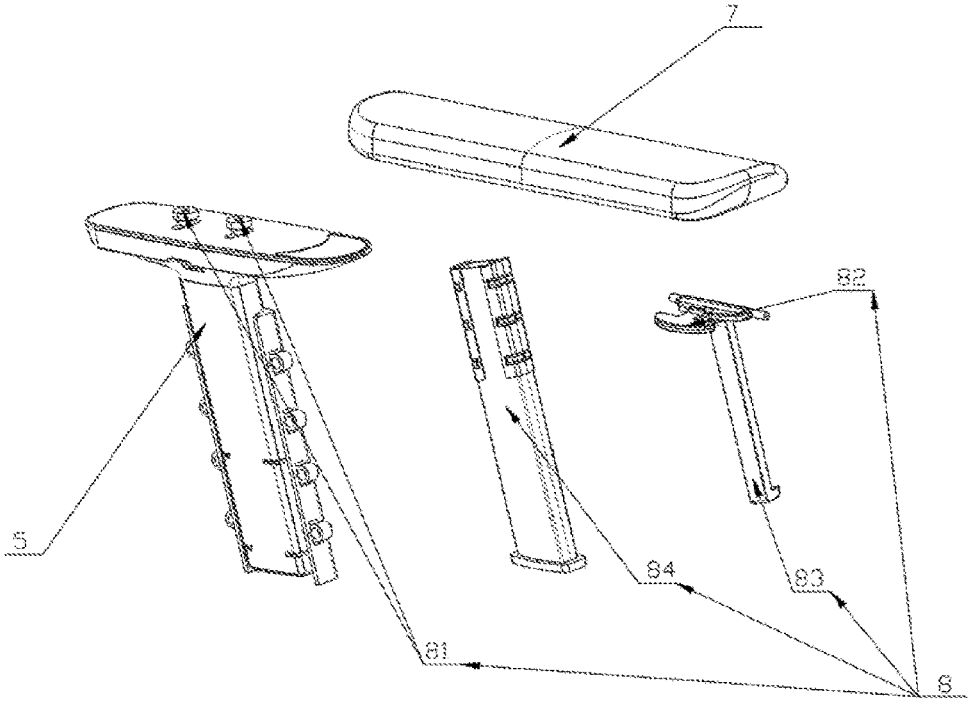
FIG. 4 is an exploded view of an embedded armrest and an embedded armrest adjustment mechanism of the utility model.
Figure 5:
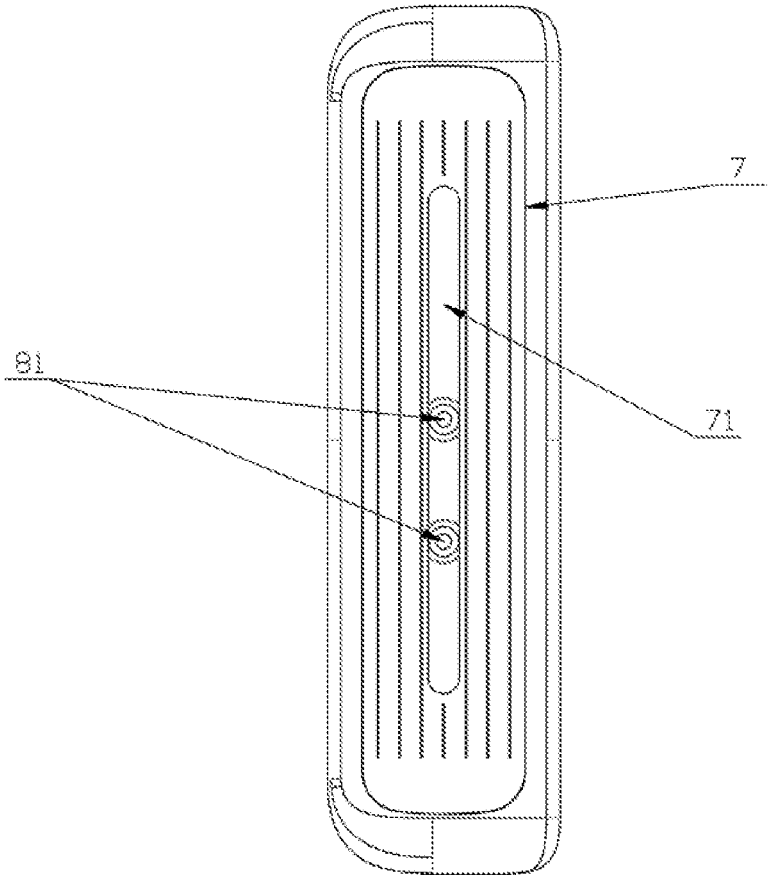
FIG. 5 is a diagram of the cooperation between a sliding block and an embedded armrest of the utility model.
Figure 6:
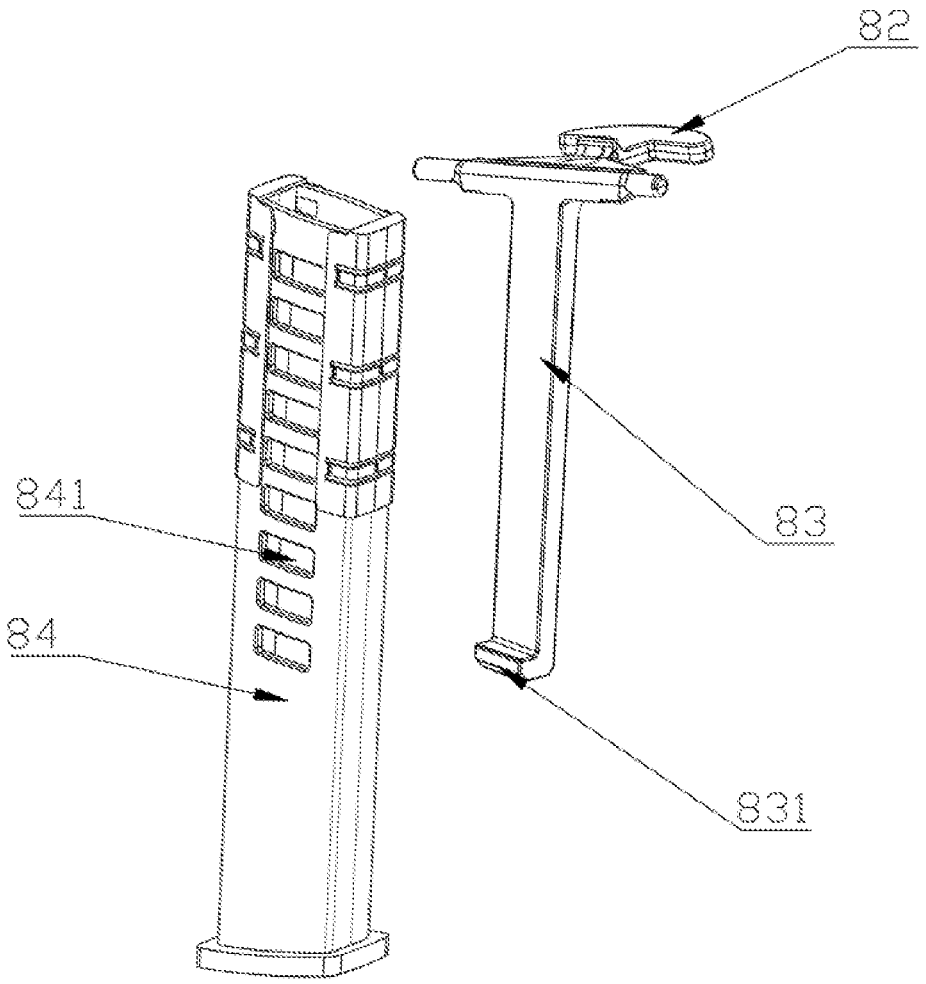
FIG. 6 is an exploded view of an embedded armrest adjustment mechanism of the utility model.
Figure 7:
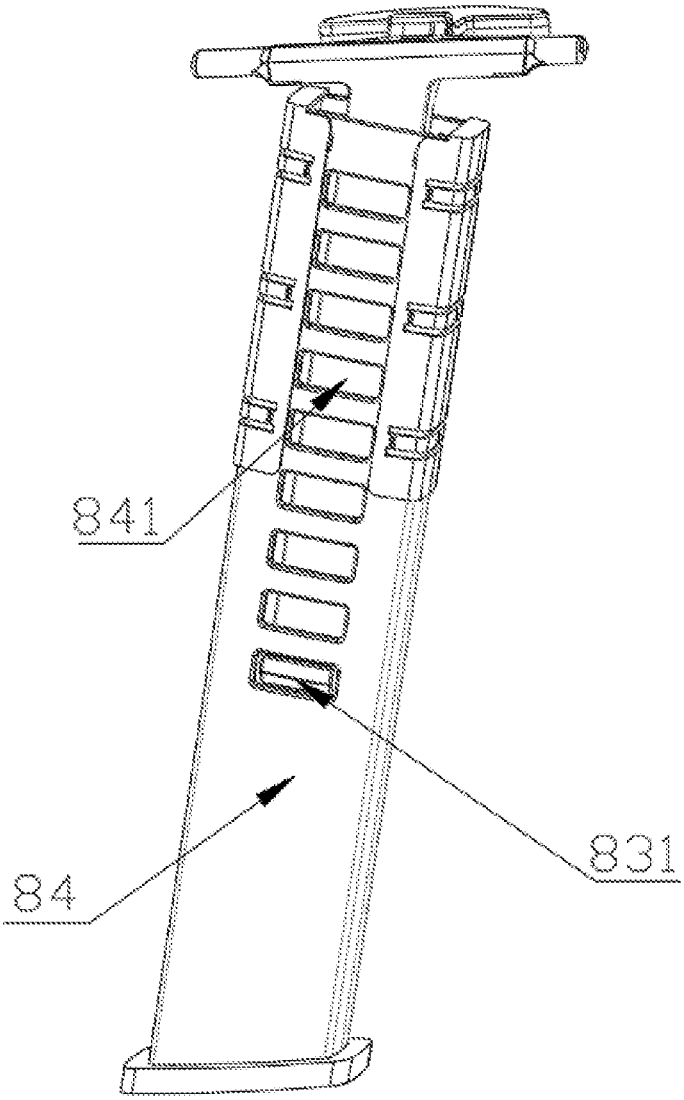
FIG. 7 is a diagram of the cooperation between an embedded armrest and an embedded armrest adjustment mechanism of the utility model.
Figure 8:
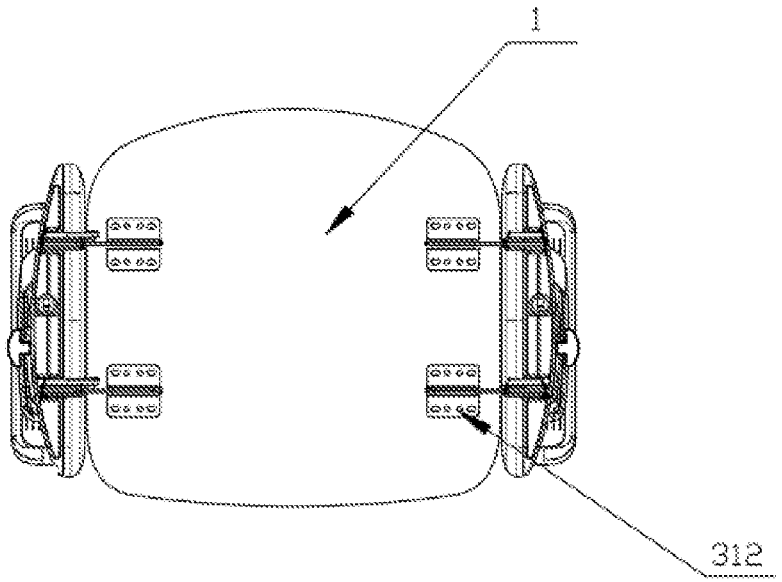
FIG. 8 is a diagram of the cooperation between a fixed rod and a chair seat of the utility model.
Figure 9:
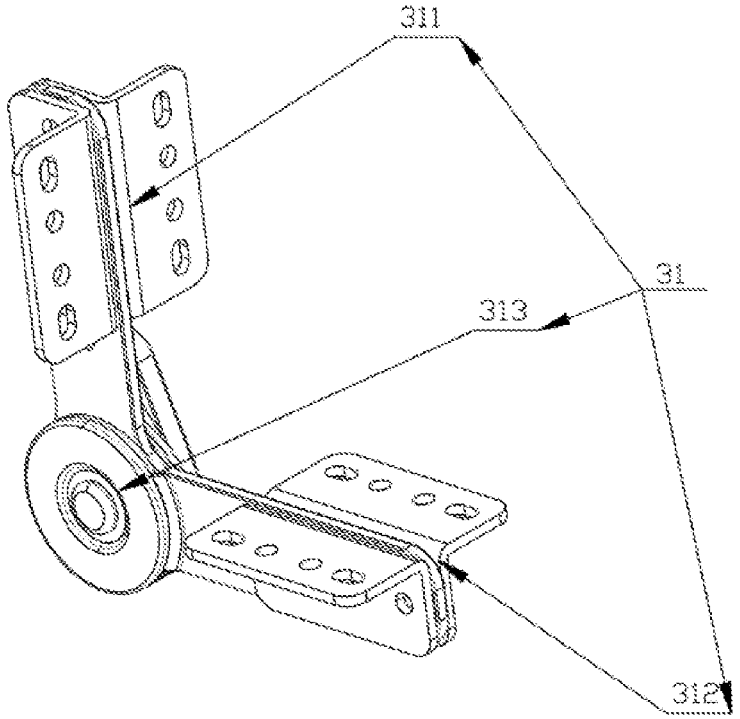
FIG. 9 is a diagram of an armrest angle adjustment mechanism of the utility model.
Figure 13:
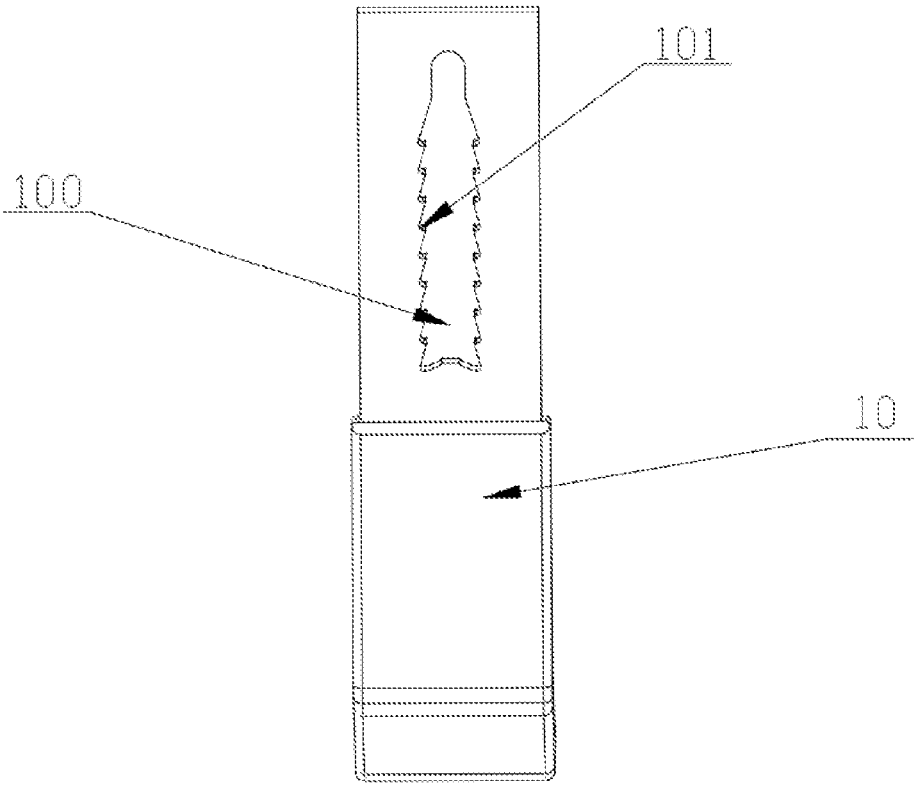
FIG. 13 is a front view of a backrest support of the utility model.

In another embodiment, all the technical features of the above embodiment are included. Referring to FIGS. 1, 3 and 13, a surface of one end, close to the chair backrest 4, of the backrest support 10 is provided with a limiting through hole 100, and the backrest support 10 is sleeved with a fixing block 11 which is fixed on the chair backrest 4. The fixing block 11 is sleeved outside the backrest support 10, and at least one second limiting slot 101 is arranged in the limiting through hole 100. The fixing block 11 can be snapped into the second limiting slot 101. The chair backrest 4 slides on the backrest support 10 through the fixing block to adjust the longitudinal height. The height can be fixed through the snap-in connection between the fixing block 11 on the chair backrest 4 and the second limiting slot 101 in the limiting through hole 101. The plurality of second limiting slots 101 are formed in the limiting through hole 100, so as to realize height adjustment. This feature, combined with the desk board 42, enables users to adaptively adjust to their preferred height.

The utility model has the following advantages.

(1) The chair offers multiple usage postures, allowing users to lie flat, sit in reverse, sit sideways, and sit in a forward-facing position, thus meeting various user requirements.

(2) The chair backrest is provided with an overturnable desk board, and users can adjust the armrests to a flat or vertical downward position to work, study, watch movies, or engage in other leisure activities on the desk board.

(3) The desk board can be externally connected to the embedded armrest, and the embedded armrest can be adjusted in four directions (forward, backward, upward, and downward), providing users of different body types and heights with a personalized usage experience.

(4) The height of the chair backrest can be adjusted to meet the individual height needs of different users.

Only a few specific embodiments of the utility model are disclosed above, and the utility model is not limited thereto. Any changes that can be thought of by those skilled in the art shall fall within the scope of protection of the utility model.

What is claimed is:

1. A comfortable chair suitable for multiple usage postures, comprising:

a chair seat;

chair legs;

two chair armrests symmetrically arranged on two sides of the chair seat;

a chair backrest; and at least one desk board adjustment mechanism;

wherein a pneumatic rod is arranged between the chair seat and the chair legs, and the chair seat and the chair legs are connected through the pneumatic rod;

wherein a backrest frame is arranged on a side, away from the chair seat, of the chair backrest, a desk board is arranged in the backrest frame and connected with the backrest frame, the desk board is flippable relative to the backrest frame, a chair support is arranged between the chair backrest and the chair seat, a first end of the chair support is arranged in the backrest frame, and a second end of the chair support is connected with the chair seat;

wherein the at least one desk board adjustment mechanism is arranged on a surface of the backrest frame, and the at least one desk board adjustment mechanism comprises a strip-shaped chute, a sliding stop block and an overturning shaft;

wherein the sliding stop block is in sliding fit with the strip-shaped chute, a wall of the strip-shaped chute comprises at least one first limiting slot, one side of the sliding stop block is provided with a limiting protrusion which is able to embed into the first limiting slot, and two ends of the overturning shaft are respectively connected with the sliding stop block and the desk board;

wherein the overturning of the desk board drives the overturning shaft, so that the sliding stop block slides in the strip-shaped chute, and when the limiting protrusion is snapped into the limiting slot, the angle of the desk board is fixed;

wherein an end, away from the chair seat, of the chair armrest is provided with the embedded armrest, an embedded armrest adjustment mechanism and a housing, the embedded armrest adjustment mechanism is arranged in the housing, the housing is arranged in the chair armrest, and the embedded armrest is able to move relative to the chair armrest through the embedded armrest adjustment mechanism.

2. The comfortable chair suitable for multiple usage postures according to claim 1, wherein two ends of a bottom of the chair backrest are recessed towards a center of the chair backrest to form concave parts, and an edge of the backrest frame is provided with a mounting slot for mounting fabric.

3. The comfortable chair suitable for multiple usage postures according to claim 1, wherein the embedded armrest adjustment mechanism comprises sliding blocks, a height adjustment handle, a lifting rod and a lifting cylinder, a side, close to the chair armrest, of the embedded armrest is provided with a strip-shaped slot hole, a first end of at least one sliding block is arranged in the strip-shaped slot hole, and a second end of the at least one sliding block is fixedly connected with the housing; and the height adjustment handle is arranged on a side, away from the chair seat, of the housing, and is integrated with the lifting rod, the lifting rod is arranged in a chamber of the lifting cylinder, and is provided with stop blocks, at least one height fixing hole is arranged on a chamber surface, close to the stop blocks, of the lifting cylinder, and the stop blocks are capable of snapping into the height fixing holes.

4. The comfortable chair suitable for multiple usage postures according to claim 1, further comprising an armrest angle adjustment mechanism, wherein the chair armrest is movably connected with the chair seat through the armrest angle adjustment mechanism, and the armrest angle adjustment mechanism comprises a rotating rod, a fixed rod and a rotating wheel; a first end of the rotating rod is fixedly connected with the chair armrest, and a second end of the rotating rod is rotatably connected with the rotating wheel; and two ends of the fixed rod are respectively fixedly connected with the rotating wheel and the chair seat, and the adjustment range of an included angle between the chair armrest and the chair seat is from acute to reflex angles.

5. The comfortable chair suitable for multiple usage postures according to claim 1, wherein a surface of one end, close to the chair backrest, of the backrest support is provided with a limiting through hole, and the backrest support is sleeved with a fixing block which is fixed on the chair backrest; the fixing block is sleeved outside the backrest support, at least one second limiting slot is arranged in the limiting through hole, and the fixing block is capable of snapping into the second limiting slot; and the chair backrest slides on the backrest support through the fixing block to adjust the longitudinal height.

6. A comfortable chair suitable for multiple usage postures, comprising:

a chair seat;

chair legs;

two chair armrests symmetrically arranged on two sides of the chair seat;

an armrest angle adjustment mechanism;

a chair backrest; and at least one desk board adjustment mechanism;

wherein a pneumatic rod is arranged between the chair seat and the chair legs, and the chair seat and the chair legs are connected through the pneumatic rod;

wherein a backrest frame is arranged on a side, away from the chair seat, of the chair backrest, a desk board is arranged in the backrest frame and connected with the backrest frame, the desk board is flippable relative to the backrest frame, a chair support is arranged between the chair backrest and the chair seat, a first end of the chair support is arranged in the backrest frame, and a second end of the chair support is connected with the chair seat;

wherein the at least one desk board adjustment mechanism is arranged on a surface of the backrest frame, and the at least one desk board adjustment mechanism comprises a strip-shaped chute, a sliding stop block and an overturning shaft;

wherein the sliding stop block is in sliding fit with the strip-shaped chute, a wall of the strip-shaped chute comprises at least one first limiting slot, one side of the sliding stop block is provided with a limiting protrusion which is able to embed into the first limiting slot, and two ends of the overturning shaft are respectively connected with the sliding stop block and the desk board;

wherein the overturning of the desk board drives the overturning shaft, so that the sliding stop block slides in the strip-shaped chute, and when the limiting protrusion is snapped into the limiting slot, the angle of the desk board is fixed;

wherein the chair armrest is movably connected with the chair seat through the armrest angle adjustment mechanism, and the armrest angle adjustment mechanism comprises a rotating rod, a fixed rod and a rotating wheel; a first end of the rotating rod is fixedly connected with the chair armrest, and a second end of the rotating rod is rotatably connected with the rotating wheel; and two ends of the fixed rod are respectively fixedly connected with the rotating wheel and the chair seat, and the adjustment range of an included angle between the chair armrest and the chair seat is from acute to reflex angles.

7. A comfortable chair suitable for multiple usage postures, comprising:

a chair seat;

chair legs;

two chair armrests symmetrically arranged on two sides of the chair seat;

a chair backrest; and at least one desk board adjustment mechanism;

wherein a pneumatic rod is arranged between the chair seat and the chair legs, and the chair seat and the chair legs are connected through the pneumatic rod;

wherein a backrest frame is arranged on a side, away from the chair seat, of the chair backrest, a desk board is arranged in the backrest frame and connected with the backrest frame, the desk board is flippable relative to the backrest frame, a chair support is arranged between the chair backrest and the chair seat, a first end of the chair support is arranged in the backrest frame, and a second end of the chair support is connected with the chair seat;

wherein the at least one desk board adjustment mechanism is arranged on a surface of the backrest frame, and the at least one desk board adjustment mechanism comprises a strip-shaped chute, a sliding stop block and an overturning shaft;

wherein the sliding stop block is in sliding fit with the strip-shaped chute, a wall of the strip-shaped chute comprises at least one first limiting slot, one side of the sliding stop block is provided with a limiting protrusion which is able to embed into the first limiting slot, and two ends of the overturning shaft are respectively connected with the sliding stop block and the desk board;

wherein the overturning of the desk board drives the overturning shaft, so that the sliding stop block slides in the strip-shaped chute, and when the limiting protrusion is snapped into the limiting slot, the angle of the desk board is fixed;

wherein a surface of one end, close to the chair backrest, of the backrest support is provided with a limiting through hole, and the backrest support is sleeved with a fixing block which is fixed on the chair backrest; the fixing block is sleeved outside the backrest support, at least one second limiting slot is arranged in the limiting through hole, and the fixing block is capable of snapping into the second limiting slot; and the chair backrest slides on the backrest support through the fixing block to adjust the longitudinal height.

* * * * *